United States Patent [19]

Maloney

[11] Patent Number: 4,697,491

[45] Date of Patent: Oct. 6, 1987

[54] ELECTRIC FEEDBACK GUITAR

[76] Inventor: Terrance R. Maloney, 607 W. Springfield, Champaign, Ill. 61820

[21] Appl. No.: 875,018

[22] Filed: Jun. 17, 1986

[51] Int. Cl.[4] ..... G10H 3/24; G10H 3/18

[52] U.S. Cl. ..... 84/1.05; 84/1.16; 84/DIG. 10

[58] Field of Search ..... 84/1.16, 1.14, 1.24, 84/1.05, DIG. 10

[56] References Cited

U.S. PATENT DOCUMENTS

| | | | |
|---|---|---|---|
| 518,775 | 4/1894 | Birrer . | |
| 3,357,291 | 12/1967 | Carmichael | 84/267 |
| 3,449,531 | 6/1969 | Ashworth | 179/115 |
| 3,571,480 | 3/1971 | Tichenor et al. | 84/1.05 |
| 3,696,700 | 10/1972 | Berardi | 84/291 |
| 4,075,921 | 2/1978 | Heet | 84/1.16 |
| 4,236,433 | 12/1980 | Holland | 84/DIG. 10 |
| 4,245,540 | 1/1981 | Groupp | 84/1.14 |
| 4,248,120 | 2/1981 | Dickson | 84/1.05 |
| 4,484,508 | 11/1984 | Nourney | 84/DIG. 10 |

*Primary Examiner*—Stanley J. Witkowski
*Assistant Examiner*—David S. Warren

[57] ABSTRACT

An electric stringed instrument such as a guitar having a sound reproducing element on the top of the neck for feeding the tones of the strings back into the guitar. (A sound reproducing element being a speaker or an electromagnetic transducer.) The tones of the strings are sent from the pickup to an amplifier and then to the sound reproducing element. This feedback will either prolong the note played or one of its harmonics or will not have any effect depending upon which note is played. Two wires are imbedded in the back of the neck to bring the electric signal to the sound reproducing element.

6 Claims, 3 Drawing Figures

ELECTRIC FEEDBACK GUITAR

U.S. PATENT DOCUMENTS CITED

U.S. Pat. No. 518,775; 4/1894; Birrer.
U.S. Pat. No. 3,357,291; 12/1967; Carmichael; 84/267.
U.S. Pat. No. 3,696,700; 10/1972; Berardi; 84/291.
U.S. Pat. No. 3,449,531; 6/1969; Ashworth; 179/115.

FIELD OF INVENTION

The invention relates to stringed instruments class 84, subclass 267, and subclass 293.

SUMMARY

An electric stringed instrument such as a guitar having a sound reproducing element on the top of the neck for feeding the tones of the strings back into the guitar. (A sound reproducing element being a speaker or an electromagnetic transducer.) The tones of the strings are sent from the pickup to an amplifier and then to the sound reproducing element. This feedback will either prolong the note played or one of its harmonics or will not have any effect depending upon which note is played.

DISCUSSION OF PRIOR ART

The only sound modification found in a musical instrument neck was Birrer U.S. Pat. No. 518,775 which disclosed an acoustic sound hole in the head of the neck (year—1894).

A speaker is built into a guitar body in Carmichael U.S. Pat. No. 3,357,291, for the purpose of amplification (col. 1; line 15). This invention assures that the speaker vibrations do not effect the resonant qualities of the top panel (col. 2; line 69); thereby suppressing feedback.

Berardi in U.S. Pat. No. 3,696,700 attempts to reduce feedback in stringed instruments containing speakers (col. 1; line 19). In contrast to prior art, my invention purposely induces feedback and purposely effects the resonance of the instrument.

Groupp in U.S. Pat. No. 4,245,540 purposely induces feedback of tones. Because the speaker is in the body of the guitar and is very close to the magnetic pickups, Groupp employs acoustic shielding and magnetic shielding. The invention herein described does not need any shielding because of the large distance between the pickups and the transducer on top of the neck. Groupp is satisfied with only 3 watts of audio power (Col. 6; line 41); whereas this invention can use more than 20 watts—creating very extreme feedback effects.

Ashworth in U.S. Pat. No. 3,449,531 invented an electro-mechanical transducer. This device has an advantage over the speaker as the sound reproducing element of the invention: it is much quieter.

THE OBJECT OF THE INVENTION

The object of the invention is to provide musicians a guitar with improved feedback capabilities. Standard guitars must be amplified very very loud to induce feedback. As the volume is diminished the feedback diminishes.

Guitars with speakers in the body have an advantage in feedback over standard guitars in that the speakers are attached directly to the wood, thus transmitting sound vibrations more efficiently. Unfortunately, the volume of the speaker cannot be turned up very loud without emitting a high squeeling noise; thus feedback is at a diminished level.

The invention herein described overcomes this limitation by attaching the sound reproducing element on top of the neck. With approximately 15–25 more inches between the sound reproducing element and the pickup, the volume of the sound reproducing element can be further increased before emitting the high squeeling noise. By increasing the sound vibrations into the wood, feedback is improved.

DESCRIPTION OF STRUCTURE

Figure 1:
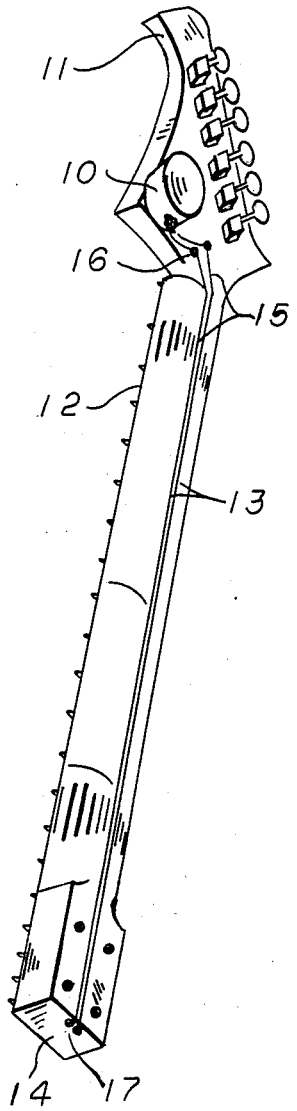
FIG. 1 is a perspective view of the back side of the neck of the invention.

The best mode of the invention is described physically as follows:

In FIG. 1 an electro-magnetic transducer 10 is screwed into the back of the peghead 11 of a guitar neck 12. If the transducer 10 is unavailable for purchase, make one following the instructions in U.S. Pat. No. 3,449,531.

Cut two grooves 13 down the back of the neck 12 from the peghead 11 all the way to the bottom 14. Press bare wires 15 gauge #22 into the grooves 13. Brush lacquer over the grooves 13 on top of the copper wires 15 as protective sealing.

Wrap the copper wires 15 around the screws 16 on the back of the peghead 11 and around the screws 17 on the bottom 14 of the neck 12. Connect the transducer 10 to copper wires 15 at screws 16.

Figure 2:
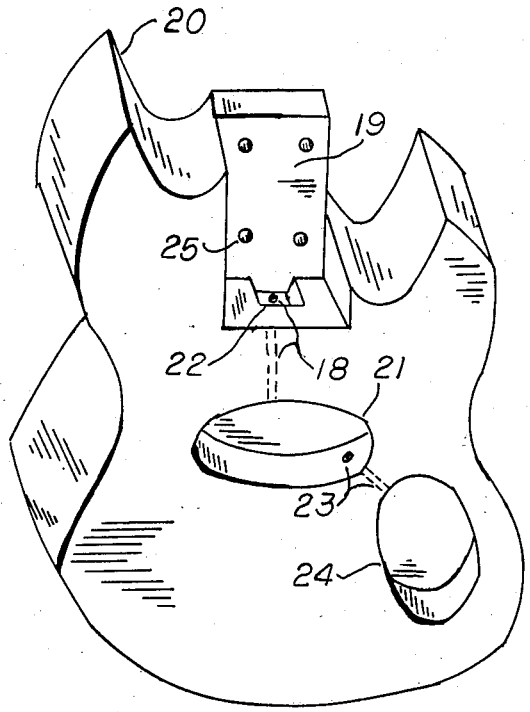
FIG. 2 is a perspective view of the top side of the body of the invention.

As in FIG. 2, drill a ¼" diameter hole 18 from the center of the neck cavity 19 in the solid wood body 20 to the pickup cavity 21. Carve a small rectangle 22 in the wall of the neck cavity 19 for the heads of screws 17 to fit in. Drill a ¼" diameter hole 23 between the pickup cavity 21 and the electronic control cavity 24.

Install a ¼" chassis mount speaker jack in the electronic control cavity 24 using a nonconductive grommet to avoid grounding complications. Run two-conductor speaker wire from the ¼" speaker jack through hole 23 to the pickup cavity 21 and then through hole 18 and out rectangle 22 leaving about 3" of wire protruding out. Attach this slack speaker wire to the bottom 14 of the neck 12 by screws 17.

Pull the slack speaker wire back into the pickup cavity 21 as you place the neck 12 in place in the neck cavity 19. Insert wood screws through the four mounting holes 25 and bolt the neck 12 to the body 20.

I suggest using a separate amplifier for the sound reproducing element in addition to the normal amplifier for the listening audience. The musician could then lower the volume for his listening audience without loosing feedback.

I also suggest using compression circuitry for the signal going into the amplifier for the sound reproducing element. This will flatten the volume peaks of the plucked strings, thus improving the signal for continuous feedback flow.

The guitar may use one electric guitar pickup for both amplifiers (use a Y-JACK); or the guitar may use two pickups (one for each amplifier). Using two pickups allows the musician to adjust the pole pieces differently.

A very useful addition to the invention is to install a switch for reversing the electric signal in the two-conductor speaker wire. Different harmonics are enhanced when the polarity of the electromagnet in the transducer 10 is reversed. This switch may be installed in the electronic control cavity 24, or in a foot operable switch box, or both.

OTHER EMBODIMENTS

Figure 3:
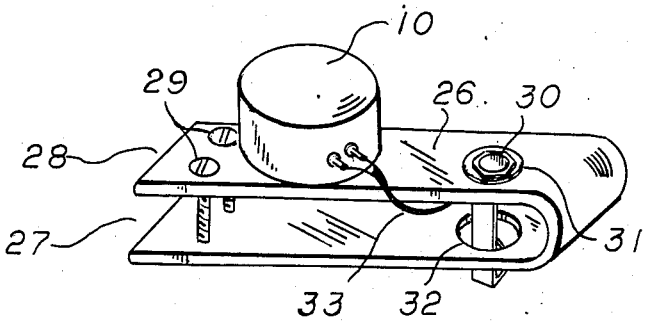
FIG. 3 is a perspective view of a clamping embodiment of the invention.

Some musicians would prefer to buy a feedback inducing device which they could clamp to a guitar they already own. FIG. 3 shows a transducer 10 attached to a 1½" wide, ⅛" thick piece of aluminum 26 which is bent backward with ½" spacing 27. Fit the open end 28 of the aluminum onto a peghead of a stringed instrument and tighten the screws 29, thus clamping the sound reproducing element onto the neck. Mount a ¼" chassis mount speaker jack 30 in the aluminum 26 using a rubber or nylon grommet 31. Because the jack 30 is larger than the ½" spacing 27, an accommodating hole 32 must be drilled in the opposite site of the clamp. Connect the transducer 10 to the speaker jack 30 with two-conductor speaker wire 33. Also possible (not shown in FIG. 3), the clamp may be extended longer to add a reversing switch for the two-conductor speaker wire 33.

Some musicians would prefer to buy only the neck 12 of the invention herein described. They would then modify the body 20 of the guitar they already own with hole 18 and rectangle 22 and attach the neck 12.

I claim:

1. An electric stringed instrument having a plurality of strings, a neck, a body, and a pickup for driving an amplifier comprising:

(a) a sound reproducing element attached to the top of the neck for transducing the tones of the strings into the neck;

(b) an electrical connector in the body for receiving the output of the amplifier;

(c) wire means for conducting electric signal from the electrical connector in the body to the sound reproducing element at the top of the neck.

2. The electric stringed instrument of claim 1 further comprising a switch for reversing the electric signal in the wire means for the sound reproducing element.

3. The electrical stringed instrument of claim 2 wherein the switch is foot operable.

4. A feedback inducing device for electric stringed instruments having a neck, a body, a plurality of strings, and a pickup for driving an amplifier comprising:

(a) means for clamping on to the neck of a stringed instrument;

(b) a sound reproducing element attached to the clamping means for transducing the tones of the strings into the neck;

(c) an electrical connector attached to the clamping means for receiving the output of the amplifier;

(d) wire means for conducting electric signal from the electrical connector to the sound reproducing element.

5. The feedback inducing device of claim 4 further comprising a switch for reversing the electric signal in the wire means for the sound reproducing element.

6. The feedback inducing device of claim 5 wherein the switch is foot operable.

* * * * *